US010184314B1

(12) United States Patent
Bair et al.

(10) Patent No.: US 10,184,314 B1
(45) Date of Patent: Jan. 22, 2019

(54) DOWNHOLE VALVE WITH CAGE INSERTS

(71) Applicant: Black Gold Pump and Supply, Inc., Signal Hill, CA (US)

(72) Inventors: Michael Bair, Los Angeles, CA (US); Scott Sakakura, Los Angeles, CA (US); Simon Shin, Los Angeles, CA (US); Christopher Lindgren, Los Angeles, CA (US)

(73) Assignee: BLACK GOLD PUMP AND SUPPLY, INC., Signal Hill, CA (US)

( * ) Notice: Subject to any disclaimer, the term of this patent is extended or adjusted under 35 U.S.C. 154(b) by 147 days.

(21) Appl. No.: 15/342,371

(22) Filed: Nov. 3, 2016

Related U.S. Application Data

(60) Provisional application No. 62/344,518, filed on Jun. 2, 2016.

(51) Int. Cl.
*E21B 34/00* (2006.01)
*E21B 34/06* (2006.01)
*E21B 34/10* (2006.01)

(52) U.S. Cl.
CPC ..... *E21B 34/06* (2013.01); *E21B 34/10* (2013.01); *E21B 2034/002* (2013.01)

(58) Field of Classification Search
CPC .... E21B 34/00; E21B 34/06; E21B 2034/002; E21B 34/10
See application file for complete search history.

(56) References Cited

U.S. PATENT DOCUMENTS

| | | | | |
|---|---|---|---|---|
| 3,096,825 | A * | 7/1963 | Clark, Jr. | E21B 21/10 137/269.5 |
| 3,724,496 | A | 4/1973 | Secrist | |
| 5,297,580 | A | 3/1994 | Thurman | |
| 5,593,292 | A | 1/1997 | Ivey | |
| 6,199,636 | B1 | 3/2001 | Harrison | |
| 6,685,451 | B1 * | 2/2004 | Ivey | F04B 47/02 137/533.19 |
| 6,830,441 | B1 | 12/2004 | Williams | |
| 7,069,997 | B2 * | 7/2006 | Coyes | F04B 53/1007 137/533.11 |
| 8,453,673 | B2 * | 6/2013 | Ford | F16K 15/04 137/533.11 |
| 8,579,610 | B2 * | 11/2013 | Perkins, Jr. | F04B 47/026 137/533.11 |
| 2007/0295507 | A1 * | 12/2007 | Telfer | E21B 23/08 166/302 |
| 2012/0061103 | A1 * | 3/2012 | Hurtado | E21B 34/14 166/386 |

* cited by examiner

*Primary Examiner* — Yong-Suk Ro
(74) *Attorney, Agent, or Firm* — James M. Duncan, Esq.; Klein DeNatale Goldner

(57) ABSTRACT

A thermoplastic cage insert for a downhole valve utilized in oil production rod pumps and other downhole equipment has a full open bore with no structural member spanning across the bore of the cage insert. This design allows fluid to flow freely at the trailing end of the ball of the valve, maximizing the cross sectional flow area at the trailing end of the ball.

13 Claims, 4 Drawing Sheets

DOWNHOLE VALVE WITH CAGE INSERTS

CROSS-REFERENCE TO RELATED APPLICATIONS

This application claims domestic priority to provisional patent application No. 62/344,518 filed on Jun. 2, 2016.

BACKGROUND OF THE INVENTION

Downhole ball and seat valves are utilized in a variety of applications in the production of hydrocarbons from subsurface wells. A common application is with downhole positive displacement pumps, where the pump has a standing valve and a traveling valve. However, in addition to use as standing valves and traveling valves in downhole pumps, downhole ball and seat valves have other application in hydrocarbon well applications such as operation of various downhole tools, including packers, washers and drill stem test tools.

Using downhole pumps as a specific application, these types of pumps typically utilize a standing valve and a traveling valve. In the general application, the standing valve is utilized with the pump barrel to allow fluid to flow into the barrel during an upstroke where the plunger is pulled upward through the barrel, and to prevent fluid from being displaced from the barrel when the plunger descends through the barrel. The traveling valve is utilized with the plunger, where the valve opens on the downstroke as the plunger descends through the fluid in the barrel and closes on the upstroke as the plunger rises lifting the fluid.

Ball and seat valves have the following general structure: (1) a cylindrical tubular cage forming a through-bore; (2) an annular seat extending perpendicularly across the bore, typically at its lower end; (3) a ball positioned within the bore of the cage; (4) a transverse ball stop extending across the upper end of the bore to limit the travel of the ball; and (5) a cylindrical shell which houses the cage, seat, ball, and ball stop. In the case of downhole pumps, fluid exits upwardly around the ball and through the upper end of the bore and out of the shell into the tubing.

Some downhole valves, particularly in the case of downhole pumps, may be subjected to continuous operation with the opening/closing sequence occurring thousands of times in a single day, frequently in a corrosive environment, pumping a fluid which may include abrasive solids. This repeated cycle naturally results in wear and tear. The seal formed between the ball and seat must be capable of withstanding substantial differential pressures without leaking.

It is known to provide "inserts" inside the tubular cage to increase the durability of the ball and seat valve and improve the volumetric flow and pressure drop characteristics through the pump. However, the known cage inserts have some disadvantages. A first common disadvantage is the presence of openings in the wall of the insert allow fluid to enter between the inside wall of the shell and the outside of the insert, trapping the fluid and providing continuous contact between the fluid and the pump components, promoting corrosion and erosion. As another disadvantage, an insert with openings requires a fluid seal at or below the ball seat. This fluid seal is typically an elastomer, which have the tendency to undergo compression set and wash out during lengthy periods of operation.

Another disadvantage of the commonly utilized cage inserts is the design of the ball stops at the top of the tubular cage. The commonly used ball stops are structural members which span across the opening at the top of the tubular cage. These structural members impede fluid flow through the cage.

SUMMARY OF THE INVENTION

Embodiments of the presently disclosed valve cage inserts address the disadvantages of the presently known cage inserts. An embodiment of a valve cage according to the present invention has a cylindrical shell member having an upper end and a lower end with a longitudinal axis defined there between and a shell bore extending axially there through. A shoulder which extends circumferentially around the inner wall of the shell extends inwardly. The shoulder has a first surface and a second surface, where the first surface is perpendicular to the longitudinal axis. A valve seat is urged against the first surface of the circumferential shoulder by a tubular member or a lower bushing which makes up into the lower end of the shell. An upper bushing member makes up to the upper end of the shell. The bushing member has a sleeve section which extends into the shell bore, where the sleeve section has a proximal end adjacent to the upper end and a distal end which extends toward the circumferential shoulder of the shell bore. An insert containment portion is defined by the portion of the shell bore which extends from the second surface to the distal end of the sleeve section. A thermoplastic cylindrical insert is disposed in the insert containment portion, where the cylindrical insert has an outer surface, a top end and a bottom end and an insert bore extending between the top end and the bottom end. An insert wall is defined between the outer surface and the insert bore. The insert wall typically has no openings. A plurality of vane members extend radially inward adjacent the top end of the insert, where the combined ends of the vane members form the ball stop. A ball travel section is defined in the insert bore between the bottom end and the vane member, and a ball is disposed in the ball travel section.

In the disclosed embodiments of the present invention, the top opening of the cage has no structural members spanning across the opening in the insert bore, thereby providing a fluid exit from the cage without structural members directly in the flow path of the fluid. Instead, the ball stop is formed by the vane members which are integral to the side walls of the cage.

Also in disclosed embodiments of the present invention, when the bushing is made up to the upper end of the shell, a portion of the top end of the insert is compressed to form a seal between the bushing member and the cylindrical shell member, such that no o-ring seal is required between the bushing member and the cylindrical shell member to form a seal.

DETAILED DESCRIPTION OF THE INVENTION

Figure 1:
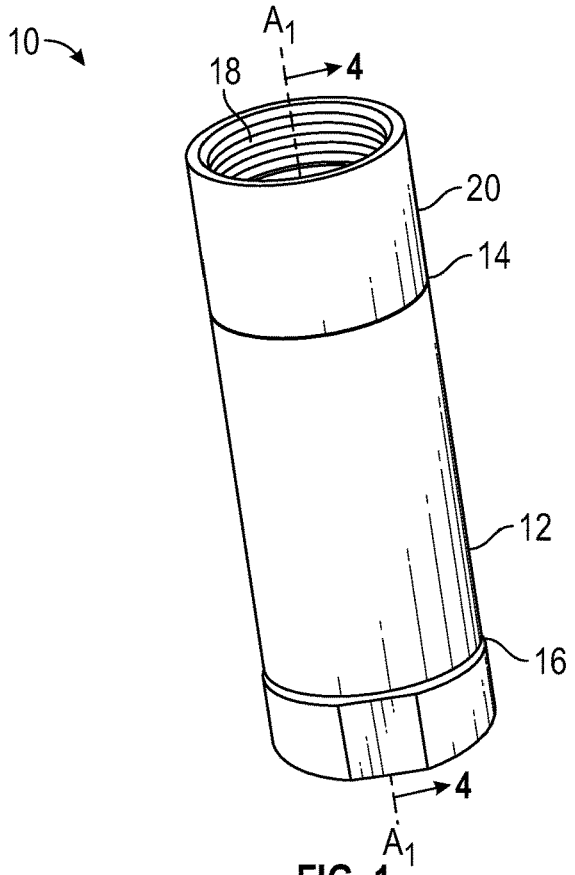
FIG. 1 depicts a perspective side view of an embodiment of the exterior of a downhole valve of the present invention.

FIG. 1 shows an embodiment of the presently disclosed downhole valve 10. FIG. 1 shows the cylindrical shell member 12, the upper end 14 of the cylindrical shell member, the lower end 16 of the shell member 12, and a longitudinal axis $A_1$ defined between the upper end 14 and the lower end 16. A shell bore 18 extends axially through the cylindrical shell member. An upper bushing 20 is typically made up into the upper end 14 of the cylindrical shell member 12 and a lower bushing 40 is typically made up into the lower end 16 of the cylindrical shell member 12. It is to be appreciated that the terms "upper", "lower", "top", "bottom", "vertical", "horizontal", "radially outward", "radially inward", and other terms designating a direction are used herein with respect to the orientation of the figures and not necessarily with a particular embodiment of the invention as it is utilized or installed.

Figure 2:
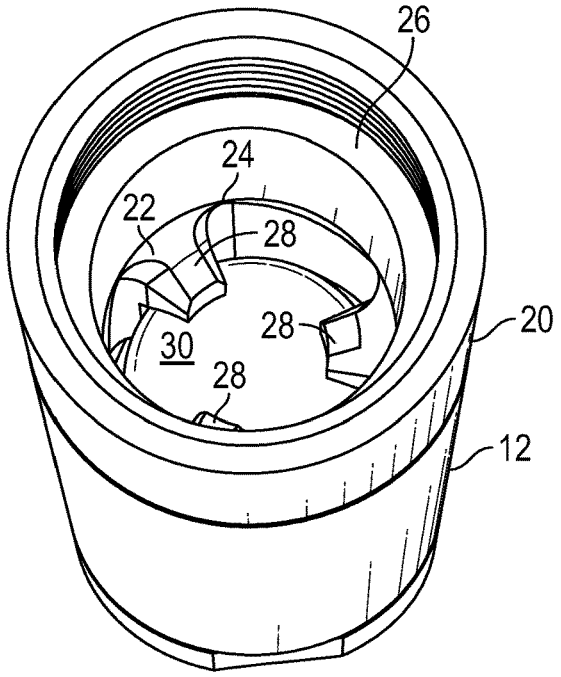
FIG. 2 depicts a perspective top view of an embodiment of the downhole valve of the present invention, showing the top end of the insert.

FIG. 2 shows a view down through the bore of bushing 20, showing a thermoplastic cylindrical insert 22 secured in place by an end 24 of a sleeve section 26 of the upper bushing 20. Cylindrical insert 22 has a plurality of vane members 28 which extend radially inward to define a ball stop for valve ball 30. It is to be appreciated that there is no structural members which cross entirely across the diameter of cylindrical shell member 12, including any portions of the cylindrical insert 22. The absence of such structural members in the fluid path provides for better flow characteristics through the downhole valve 10.

Figure 3:
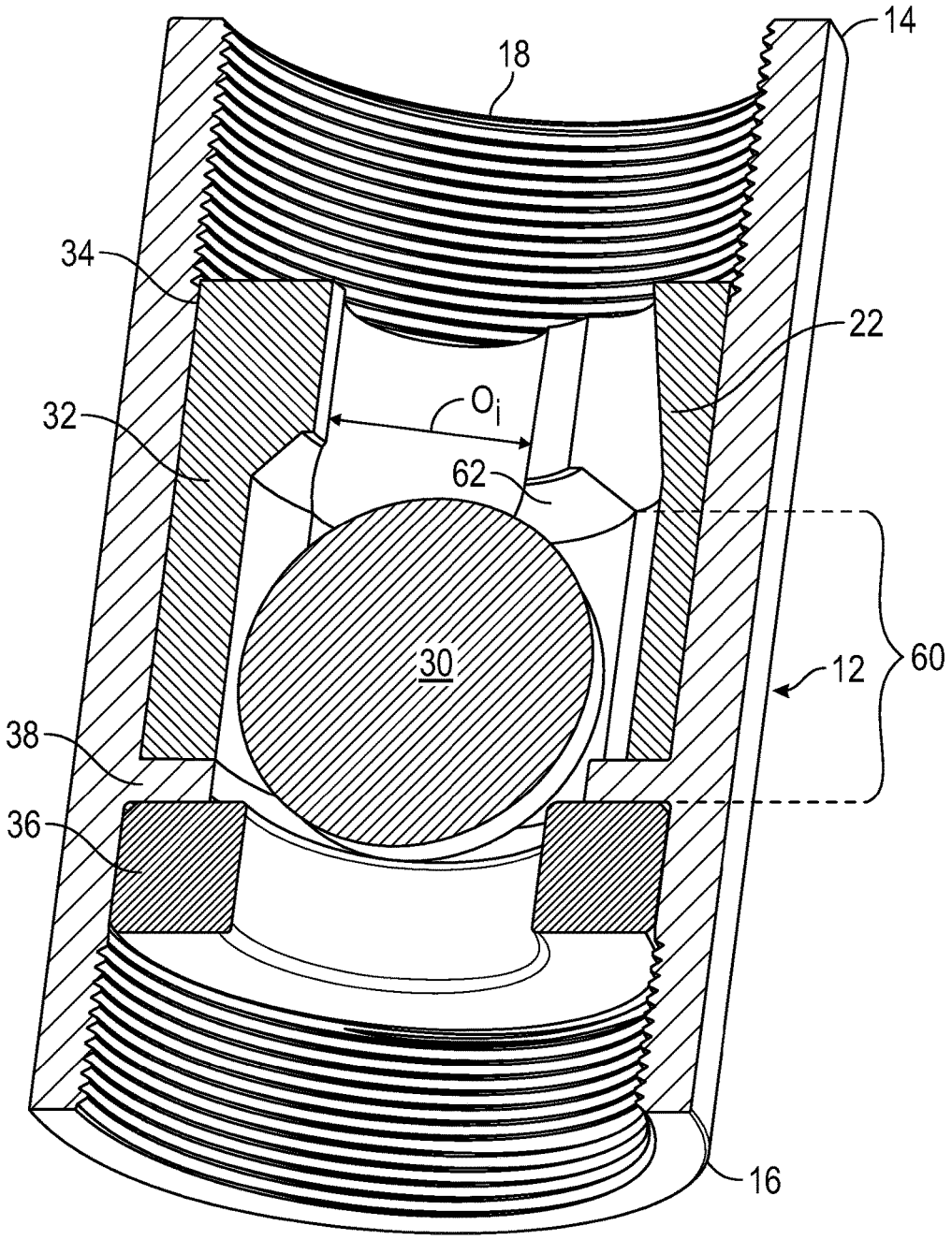
FIG. 3 is a sectioned view of an embodiment of a portion of the downhole valve of the present invention with the upper and lower bushings removed.

FIG. 3 shows the shell member 12 with the upper bushing 20 and lower bushing 40 removed. Cylindrical insert 22 is shown sectionally, showing how the walls 32 of the insert 22 have a tight fit against the inside facing wall 34 of the shell member 12. Walls 32 of the insert 22 have no openings which allow contact between well fluids and the inside facing wall 34 of the shell member 12. When upper bushing 20 is made up into the upper end 14 of the shell member 12, a portion of the top end of the insert 22 is compressed to form a seal between the bushing 20 and the shell member 12, which prevents fluid flow around the outside of the insert 22 between the insert and the inside facing wall 34. This feature of the invention eliminates the need for an o-ring which otherwise would be necessary to prevent fluid flow between the upper bushing member 20 and the shell member 12. Valve seat 36 is urged against a circumferential shoulder 38 as lower bushing 40 is made up into the threads at the lower end 16 of the shell member 12 forming a seal at the lower end of the downhole valve 10.

Figure 4:
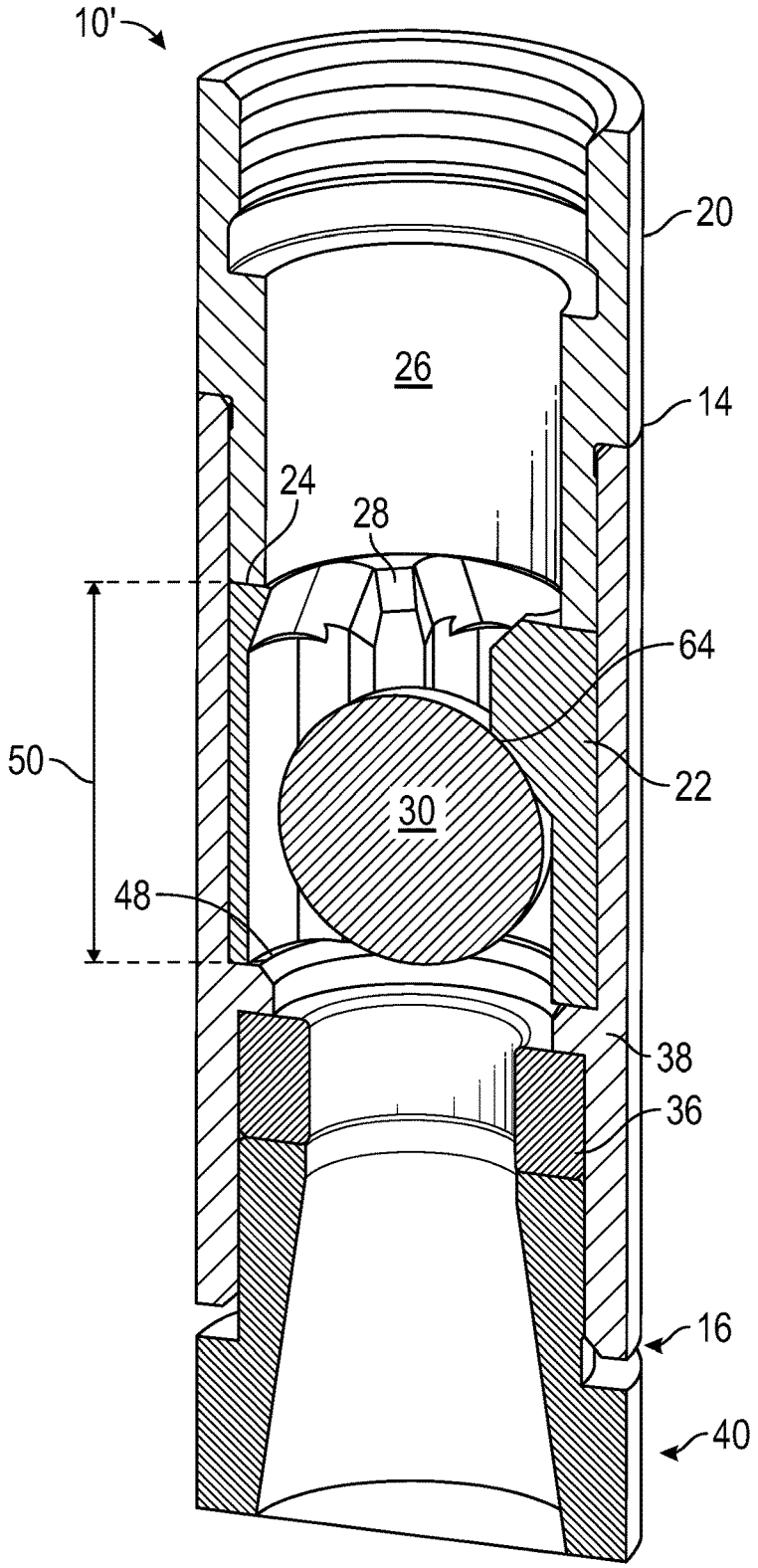
FIG. 4 is a sectioned view of an embodiment of the downhole valve of the present invention taken along line 4-4 of FIG. 1.

FIG. 4 shows an embodiment of the downhole valve 10 with lower bushing 40 attached to the lower end 16 of the shell member 12, where the lower bushing 40 urges valve seat 36 against a downward facing surface of circumferential shoulder 38. An insert containment portion 50 of shell bore 18 extends from a lower face 48 of the circumferential shoulder and an upper face 24 of the sleeve section 26 of bushing 20. Cylindrical insert 22 is disposed within the insert containment portion 50 with the insert compressed at one end by the bushing 20 and the other end by the circumferential shoulder 38. This configuration provides a fluid tight seal between the cylindrical insert 22 and the inside facing wall 34 to prevent fluid getting between the cylindrical insert 22 and the inside facing wall 34.

Figure 5:
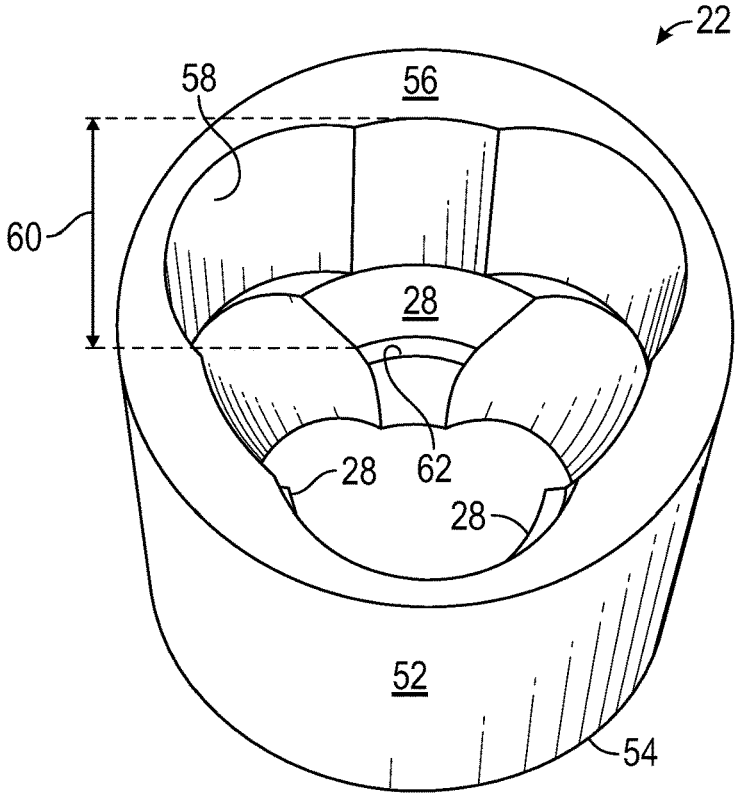
FIG. 5 shows an embodiment of a thermoplastic cylindrical insert utilized in the present invention viewed from the bottom.
Figure 6:
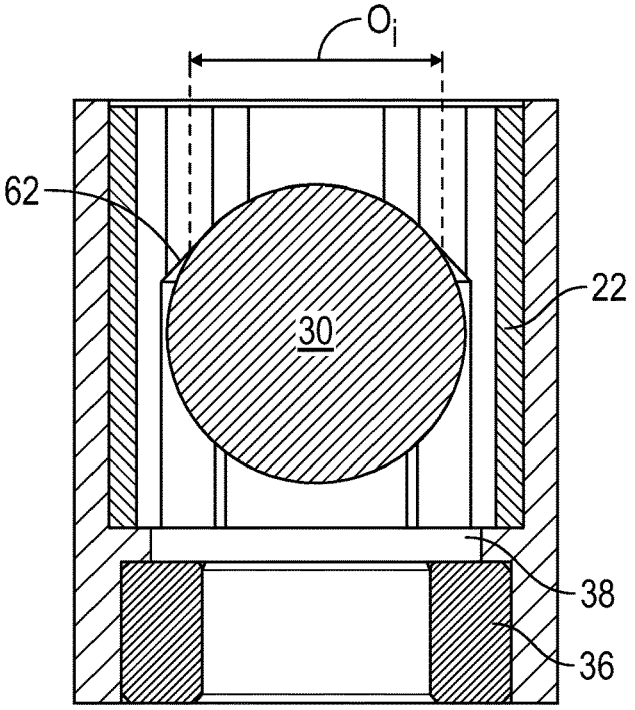
FIG. 6 is a sectioned view of a portion of an embodiment of the downhole valve of the present invention, showing the valve ball in the uppermost position, stopped by the ball stop provided by the vane members which are integral to the walls of the insert.

FIG. 5 shows a cylindrical insert 22 removed from the downhole valve 10. FIG. 5 shows the cylindrical insert 11 in an upside-down position to better show the surface of the cylindrical insert which engages ball 30, such as vane members 28 and insert bore 58. Cylindrical insert 22 is manufactured from thermoplastic materials such as nylon. The cylindrical insert 22 has an outer surface 52, a top end 54 and a bottom end 56. The cylindrical insert 22 has an insert bore 58 which extends between the top end 54 and the bottom end 56. The cylindrical insert 22 further comprises a plurality of vane members 28 which extend radially inward adjacent the top end 54 of the insert where the bottom surfaces of the vane members form a ball pocket 64 which acts a ball stop which prevents travel of the ball past the ball stop. A ball travel section 60 of the insert 22 (i.e., the portion of the insert in which surfaces of ball 30 make contact with surfaces of insert 22) is defined in the bore 58 of the insert 22 between the ball pocket 64—the upper limit of ball travel—and the bottom end 56 of the insert 22. As previously stated, the directional terms utilized herein are made with respect with the orientation of the figures. For example, an embodiment of the invention directionally oriented as generally shown in the Figures might depict a traveling valve of a downhole pump. However, the present disclosure further applies to embodiments of the invention which are utilized in applications which are oriented differently than as illustrated in the figures. For example, embodiments of the present invention may be used as a standing valve of a downhole pump.

The radially inward extending vane members 28 define an opening $O_t$ for outward flow of fluid, but it is to be appreciated that opening $O_t$ has no structural members which span across the opening. In a sense, opening $O_t$ of the cylindrical insert 22 is "full opening", and the term "full opening" is hereafter defined as an opening having no structural members spanning from one edge of the opening to an opposing edge of the opening. This feature of the insert allows fluid to flow freely at the trailing end of the ball 30, maximizing the cross sectional flow area at the trailing end of the ball. In comparison, other insert cage designs typically incorporate a bar across the top of the ball or some other type of cross members which obstruct flow as fluid is passing by the trailing end of the ball.

Having thus described the preferred embodiment of the invention, what is claimed as new and desired to be protected by Letters Patent includes the following:

1. A valve cage for a down-hole rod pump valve comprises:

a cylindrical shell member having an upper end and a lower end with a longitudinal axis defined there between and a shell bore extending axially there through, the cylindrical shell member further comprising a circumferential shoulder inwardly extending from the shell bore, the circumferential shoulder having a first surface and a second surface, the first surface perpendicular to the longitudinal axis;

a valve seat urged against the first surface of the circumferential shoulder;

an upper bushing member made up to the upper end, the bushing member having a sleeve section extending into the shell bore, the sleeve section having a proximal end and a distal end, the distal end in spaced-apart facing relation with the second surface of the circumferential shoulder, wherein an insert containment portion is defined by a portion of the shell bore extending from the second surface of the circumferential shoulder to the distal end of the sleeve section;

a thermoplastic cylindrical insert disposed in the insert containment portion, the cylindrical insert having an outer surface, a top end and a bottom end and an insert bore extending between the top end and the bottom end, wherein an insert wall is defined between the outer surface and the insert bore wherein the insert wall has no openings, the cylindrical insert further comprising a plurality of vane members extending radially inward adjacent the top end of the insert, wherein a ball travel section is defined in the insert bore between the bottom end and the vane members; and a valve ball disposed in the ball travel section.

2. The valve cage for a down-hole valve of claim 1 further comprising a lower bushing member made up to the lower end, the lower bushing member urging the valve seat against the first surface of the circumferential shoulder.

3. The valve cage for a down-hole valve of claim 1 wherein the plurality of vane members define a ball pocket, the ball pocket acting as a ball stop which prevents travel of the ball past the ball stop.

4. The valve cage for a down-hole valve of claim 3 wherein the ball pocket has an axial opening which is coaxial with the longitudinal axis.

5. The valve cage for a down-hole valve of claim 4 wherein the axial opening is full opening.

6. A valve cage for a down-hole rod pump valve comprises:

a cylindrical shell member having an upper end and a lower end with a longitudinal axis defined there between and a shell bore extending axially there through, the cylindrical shell member further comprising a circumferential shoulder inwardly extending from the shell bore, the circumferential shoulder having a first surface and a second surface, the first surface perpendicular to the longitudinal axis;

a valve seat urged against the first surface of the circumferential shoulder;

an upper bushing member made up to the upper end, the upper bushing member having a sleeve section extending into the shell bore, the sleeve section having a proximal end and a distal end, the distal end in spaced-apart facing relation with the second surface of the circumferential shoulder, wherein an insert containment portion is defined by the portion of the shell bore extending from the second surface of the circumferential shoulder to the distal end of the sleeve section;

a thermoplastic cylindrical insert disposed in the insert containment portion, the cylindrical insert having an outer surface, a top end, a bottom end and an insert bore extending between the top end and the bottom end, the cylindrical insert further comprising a plurality of vane members extending radially inward adjacent the top end of the cylindrical insert, wherein an opening is defined at the top end where each of the vane members extends into the insert bore, wherein a ball travel section is defined in the insert bore between the bottom end and the opening, wherein the opening has no structural members which span the opening; and a valve ball disposed in the ball travel section.

7. The valve cage for a down-hole valve of claim 6 further comprising a lower bushing member made up to the lower end, the lower bushing urging the valve seat against the first surface of the circumferential shoulder.

8. The valve cage for a down-hole valve of claim 6 wherein the plurality of vane members define a ball pocket, the ball pocket acting as a ball stop which prevents travel of the ball past the ball stop.

9. The valve cage for a down-hole valve of claim 6 wherein the thermoplastic cylindrical insert comprises an insert wall, wherein the insert wall extends from the outer surface to the insert bore, the insert wall having no openings which extend through the insert wall between the outer surface to the insert bore.

10. A valve cage for a down-hole rod pump valve comprises:

a cylindrical shell member having an upper end and a lower end with a longitudinal axis defined there between and a shell bore extending axially there through, the cylindrical shell member further comprising a circumferential shoulder inwardly extending from the shell bore, the circumferential shoulder having a first surface and a second surface, the first surface perpendicular to the longitudinal axis;

a valve seat urged against the first surface of the circumferential shoulder;

an upper bushing member made up to the upper end, the upper bushing member having a sleeve section extending into the shell bore, the sleeve section having a proximal end and a distal end, the distal end in spaced-apart facing relation with the second surface of the circumferential shoulder, wherein an insert containment portion is defined by the portion of the shell bore extending from the second surface to the distal end of the sleeve section;

a thermoplastic cylindrical insert disposed in the insert containment portion, the cylindrical insert having an outer surface, a top end, a bottom end and an insert bore extending between the top end and the bottom end, the cylindrical insert further comprising a plurality of vane members extending radially inward adjacent the top end of the cylindrical insert, wherein an opening is defined at the top end where each of the vane members extends into the insert bore, wherein a ball travel section is defined in the insert bore between the bottom end and the opening, wherein upon the making up of the upper bushing to the upper end, a portion of the top end of the insert is compressed to form a compression seal between the upper bushing member and the cylindrical shell member, said compression seal acting as a substitute for an o-ring seal between the bushing member and the cylindrical shell member; and a valve ball disposed in the ball travel section.

11. The valve cage for a down-hole valve of claim 10 further comprising a lower bushing member made up to the lower end, the lower bushing urging the valve seat against the first surface of the circumferential shoulder.

12. The valve cage for a down-hole valve of claim 10 wherein the plurality of vane members define a ball pocket, the ball pocket acting as a ball stop which prevents travel of the ball past the ball stop.

13. The valve cage for a down-hole valve of claim 10 wherein the thermoplastic cylindrical insert comprises an insert wall, wherein the insert wall extends from the outer surface to the insert bore, the insert wall having no openings which extend through the insert wall between the outer surface to the insert bore.

* * * * *